US005606922A

United States Patent [19]

Adams et al.

[11] Patent Number: 5,606,922

[45] Date of Patent: Mar. 4, 1997

[54] TABLE LEG LATCH MECHANISM

[75] Inventors: Alan J. Adams, Shelton; Richard M. Lacouture, Ansonia; Robert J. Ferraro, Monroe, all of Conn.

[73] Assignee: Johnson Industries, Inc., Trumbull, Conn.

[21] Appl. No.: 488,810

[22] Filed: Jun. 9, 1995

[51] Int. Cl.[6] ..... A47B 3/00

[52] U.S. Cl. ..... 108/129; 248/345.1

[58] Field of Search ..... 108/129, 131, 108/53.1, 91, 27; 248/345.1, 188.6, 439, 440

[56] References Cited

U.S. PATENT DOCUMENTS

| | | | |
|---|---|---|---|
| 2,689,158 | 9/1954 | Mahr | 108/131 |
| 2,690,212 | 9/1954 | Jakeway | 248/345.1 X |
| 3,604,372 | 9/1971 | Hewett | 108/91 X |
| 3,635,172 | 1/1972 | De Saussure et al. | 108/129 |
| 4,561,622 | 12/1985 | Heinzel | 108/131 X |
| 4,573,415 | 3/1986 | Ramey | 108/129 |
| 4,841,877 | 6/1989 | Virtue | 108/91 X |
| 4,971,849 | 11/1990 | Azzar | 248/345.1 X |
| 5,279,233 | 1/1994 | Cox | 108/129 |
| 5,284,100 | 2/1994 | Thorn | 248/345.1 X |

FOREIGN PATENT DOCUMENTS

| | | | |
|---|---|---|---|
| 214774 | 5/1924 | United Kingdom | 248/345.1 |

*Primary Examiner*—Jose V. Chen

*Attorney, Agent, or Firm*—Parmelee, Bollinger & Bramblett

[57] ABSTRACT

A folding and latching mechanism for a table leg includes a recess into which a latching pin is moved when the leg is erected. A spring-loaded latching bar includes a camming surface which bears against the latching pin on a diagonal tangent. The force applied by the camming surface thus has a component tending to seat the latching pin securely into the recess throughout the time the table is in its erected condition.

11 Claims, 3 Drawing Sheets

TABLE LEG LATCH MECHANISM

TECHNICAL FIELD

This invention relates to folding tables. More particularly, it relates to a unique latch mechanism for use with such tables.

BACKGROUND ART

Folding tables are widely used in corporate and institutional settings. They are particularly suitable where facilities are subject to frequent change, such as in hotels or conference center meeting rooms. Their folding nature makes them readily storable in a minimum of space. One of the problems with such tables is that the folding mechanisms are often less rigid than desired. Another problem is that such mechanisms often require the use of more than one hand to release them and portions of the locking mechanism may be loose and subject to rattling. Furthermore, since the folded legs lie along the bottom surface of the table top, they must overlap if the table is relatively short. As a result, two different folding mechanisms may be required to accomodate the overlap. Another problem is that marring or scratching may occur from stacking the folded tables.

Accordingly, it is a primary object of the present invention to provide a latching mechanism which engages the folding leg with a firm and positive grip. Other objects are to provide such a mechanism which is easily released from its latched position by a single foot pedal; which includes protection against marring when stacked; which is essentially rattle free when the table is erected; and which is readily adaptable for use on either short or long tables. The manner in which these objects are achieved will become apparent from the following description and appended claims.

DISCLOSURE OF INVENTION

The invention comprises a latch mechanism for a table of the type having a single pedestal leg at each end. The latching mechanism can be released by either of a pair of foot pedals on opposite sides of the mechanism. When the leg is in its locked position, the mechanism is designed in such a manner that the latch remains under spring compression.

BEST MODE FOR CARRYING OUT THE INVENTION

Figure 1:
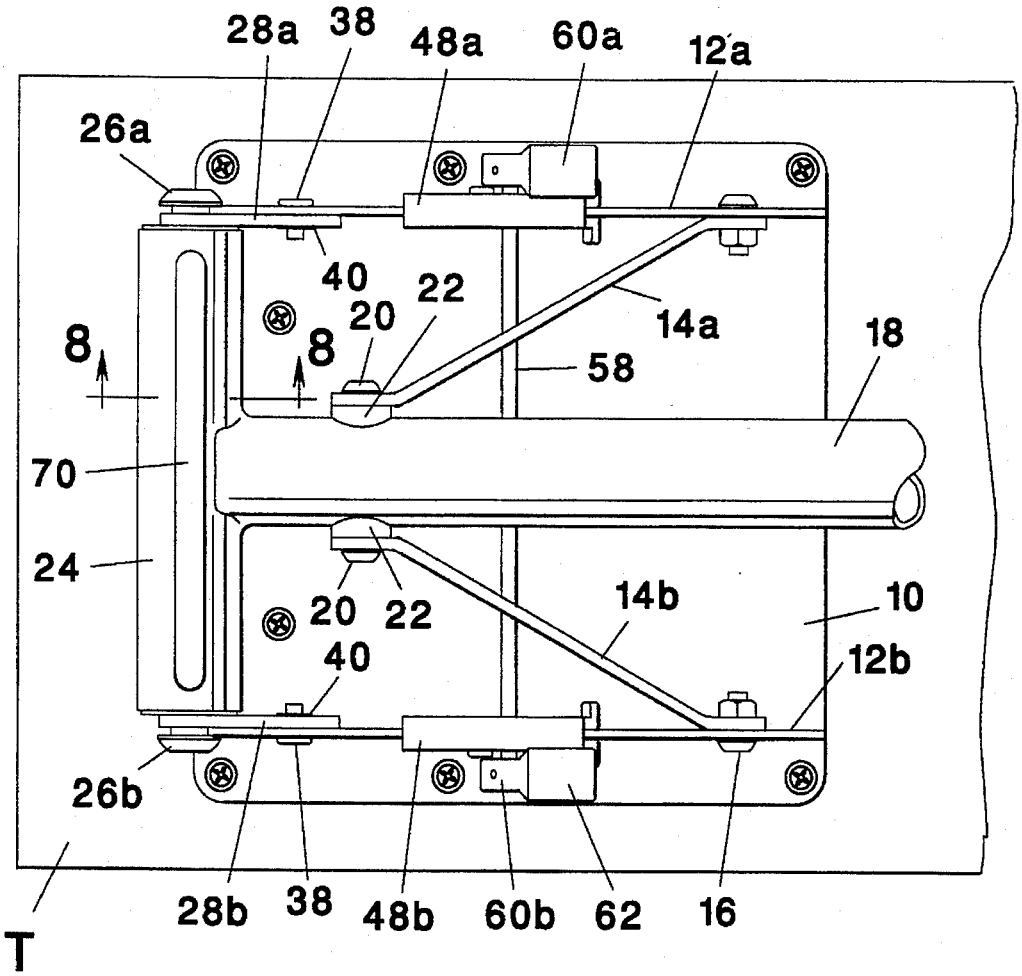
FIG. 1 is a plan view of the mechanism of the invention mounted to the underneath side of a table top in its folded position.

FIG. 1 illustrates the latching mechanism of the invention mounted to the underneath side of a table top T as it might appear in its folded position resting upon a floor. The mechanism comprises a substantially planar base 10 which is formed from a steel sheet bent in such a manner as to form a pair of spaced parallel brackets 12*a, b*. A pair of diagonal braces 14*a, b,* formed as illustrated in FIG. 1 are mounted to the respective brackets by means of pivot bolts and nuts 16. The opposite end of each bracket is mounted to a tubular leg 18 by means of cap screws 20 and grommets 22. The bottom end of the tubular leg 18 is not shown but is of conventional T-shape.

The upper end of the leg 18 is mounted to the midpoint of a pivot bar 24. The pivot bar 24 is in the form of a cylindrical tube closed at the ends from which extend respective shouldered screws forming latching pins having enlarged heads 26*a, b*. The shoulders of the latching pins form bearing surfaces on each of which is mounted one end of a pivot link 28*a, b*. The opposite end of each of the pivot links 28 defines a pair of spaced holes 30, 32, best seen in FIGS. 2 and 5. The brackets 12*a, b* are also provided with a pair of spaced openings 34, 36. The functions of the pivot holes 30, 32 and the openings 34, 36 will be explained below. As illustrated in FIGS. 1–4, a rivet 38 extends through the opening 36 in each of the brackets 12*a, b* and through the pivot hole 30 in each of the pivot links 28*a, b*. The rivet is retained by means of a push nut 40, thereby providing a pivot axis for each of the pivot links.

The upper surfaces of the two brackets 12*a, b* define a pair of aligned notches 42. Inwardly from the notch 42, each of the brackets 12*a, b* defines a horizontal slot 44 which houses therein a coiled compression spring 46 (FIG. 7). Slidably mounted on each of the brackets 12*a, b* is a respective latching bar 48*a, b*. Each of the latching bars 48 is elongated and U-shaped in cross-section as illustrated in FIG. 7 so that its sides extend downwardly over the slot 44 containing the spring 46. The inboard end of each latching bar 48 carries a pair of outwardly extending actuator tabs 50. As will be later apparent, only one of the actuator tabs 50 is operable on each latching bar 48*a, b*. However, by making them symmetrical, the latching bars become interchangable. The outboard end of each latching bar 48 includes a nose 52 and below the nose a sloped arcuate camming surface 54, both of which are shown most clearly in FIG. 6. Extending through the sidewalls of each latching bar 48, through the slot 44 in bracket 12, and between the end of spring 46 and the end of slot 44, is a rivet 56 which is retained by a push nut (not shown) on the inner surface of the corresponding bracket 12.

Figure 9:
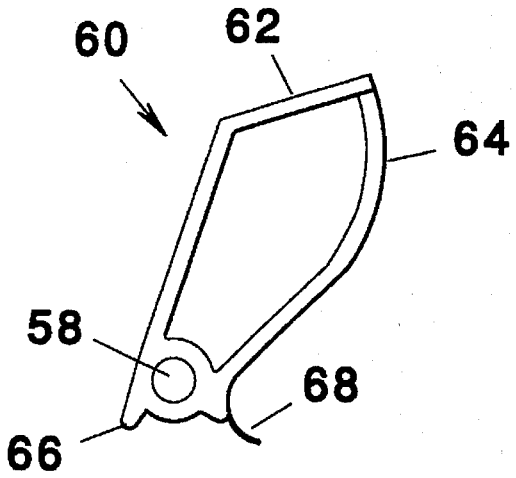
FIG. 9 is an enlarged view of one of the release levers of the invention.

Extending between, and rotatably supported in the brackets 12*a, b* is a connecting rod 58. Mounted to each end of the connecting rod 58 is a release lever 60*a, b*. Each release lever 60 includes a flat treadle surface 62 and an arcuate camming surface 64 which is positioned adjacent the actuator tab 50 of the latching bar 48. The release lever 60 is illustrated in more detail in FIG. 9. The release lever is molded from a suitably tough and springy plastic material such as acrylonitrile-butadiene-styrene copolymer. It is formed with a depending toe 66 which contacts the base 10 to limit counter-clockwise rotation as viewed in FIGS. 2–5. The release lever 60 is molded with a depending integral leaf spring portion 68 which also engages the base 10. The leaf spring 68 permits clockwise rotation about the connecting rod 58 as viewed in FIG. 9 but serves to prevent the lever from rattling when the table is erected. In one embodiment, the thickness of the release lever 60 in the vicinity of the connecting rod 58 was approximately 0.6 inch while the leaf spring 68 had a width of approximately 0.08 inch and a thickness of 0.015 inch.

Figure 8:
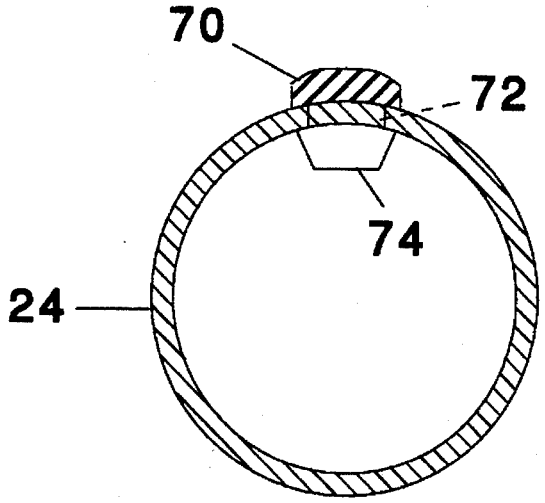
FIG. 8 is an enlarged cross-section taken along the line 8—8 of FIG. 1.

Completing the mechanism is a resilient rubber, or rubber-like, stacking strip 70. As shown most clearly in FIG. 8, the stacking strip includes a plurality of integral, spaced, and aligned stems 72 which terminate in enlarged resilient heads 74. The heads 74 are pressed through aligned openings in the pivot bar 24 to retain the stacking strip in position.

Operation

Figure 2:
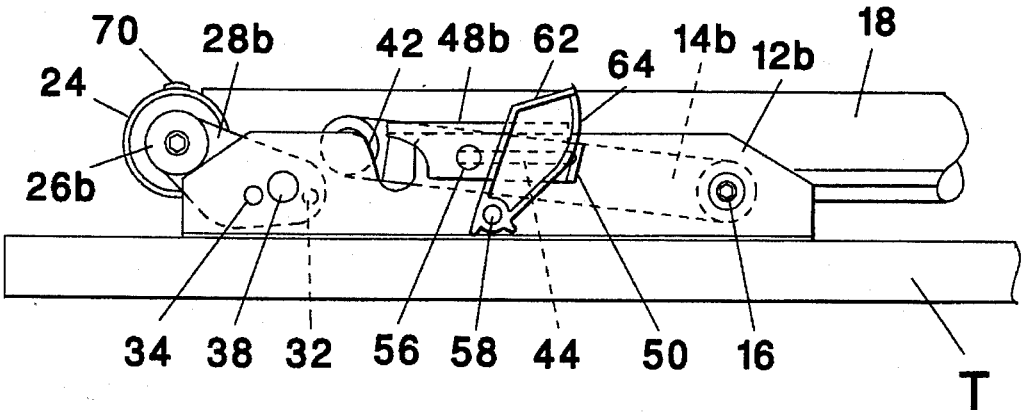
FIG. 2 is an elevational view of the mechanism of FIG. 1.

FIGS. 1 and 2 illustrate the leg folding mechanism in its folded position. It may be assumed to be lying on a surface such as a floor. In this position, the stacking strip 70 lies on the upper surface of the pivot bar 24. In most instances there will be two legs and two folding members on each table at opposite ends. The stacking strips provide a cushioning bumper when a plurality of tables are stacked together. It will also be apparent that the leg 18 lies parallel to, and closely adjacent, the table top T. If the table is sufficiently long, this arrangement will accomodate both leg mechanisms. In a shorter table however, provision must be made for one leg to overlie the other. The mechanism herein described permits such an adaptation to be easily made. This is done by using the rivet 38 to interconnect the opening 34 in the bracket 12 with the pivot hole 32 in the pivot link 28. This results in the arrangement illustrated in FIG. 5, wherein the leg 18 is raised further away from the table top T than is the case illustrated in FIG. 2.

Figure 3:
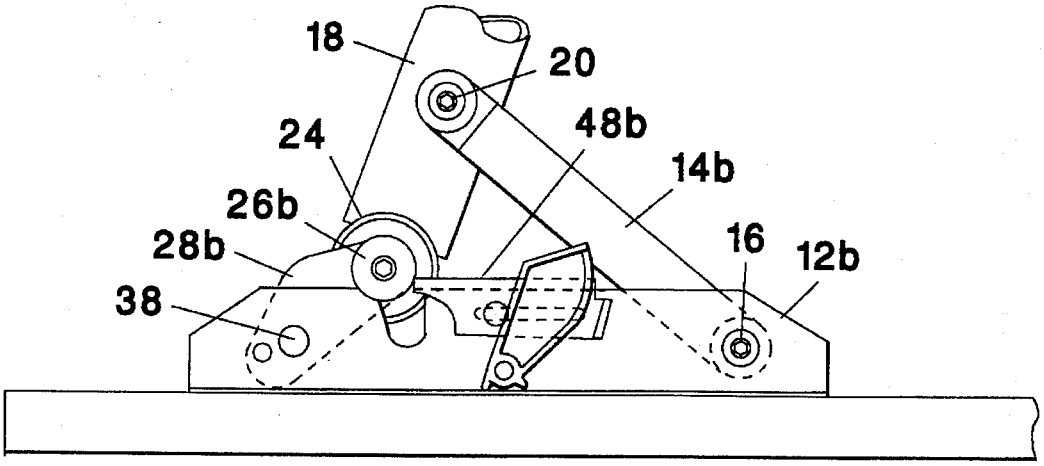
FIG. 3 is a view similar to FIG. 2 illustrating the raising of the leg pedestal into its raised position.

In order to erect the table from the position illustrated in FIGS. 1 and 2, leg 18 is raised. As the leg is raised, it pivots around diagonal braces 14*a, b* and the pivot bar 24 pivots around the pivot links 28*a, b*. The latching pin heads 26*a, b* engage the nose 52 of each of the latching bars 48*a, b*, forcing them to the right as illustrated in FIG. 3 against the compression force of the springs 46. Continuing rotation causes the latching pins to seat in the notches 42, whereupon the compression springs 46 force the latching bars 48*a, b* to the left as viewed in FIG. 4 to lock the leg in position.

Figure 6:
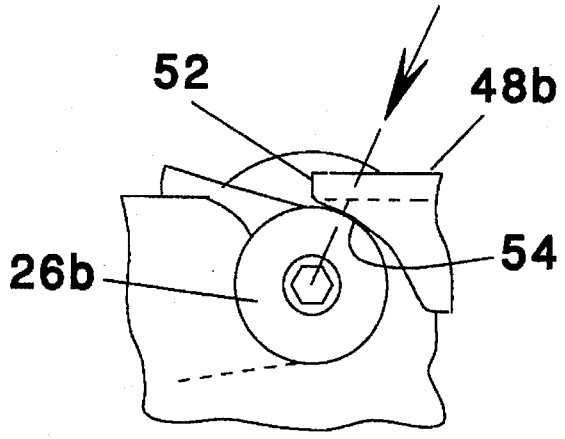
FIG. 6 is an enlarged view illustrating the manner in which the latch functions.
Figure 7:
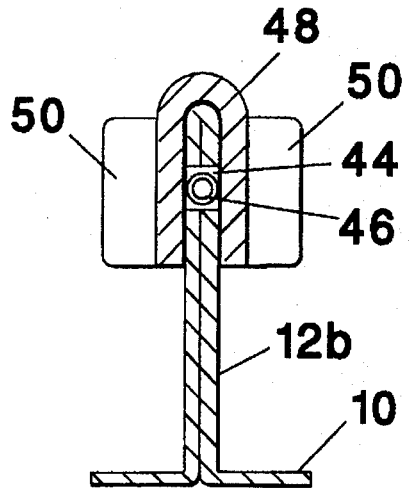
FIG. 7 is an enlarged cross-section taken along the line 7—7 of FIG. 4.

An important feature of this invention is illustrated in FIG. 6. As will be apparent from this figure, the camming surface 54 on the latching bar 48 is not concentric with the latching pin head 26*b* but is shaped to engage the latter along a diagonal tangent as illustrated by the arrow. Accordingly, there is a downward component of force which pushes each latching pin firmly into its associated recess 42. This compression force is maintained while the table is in an erected position, thereby providing and insuring rigidity.

Figure 4:
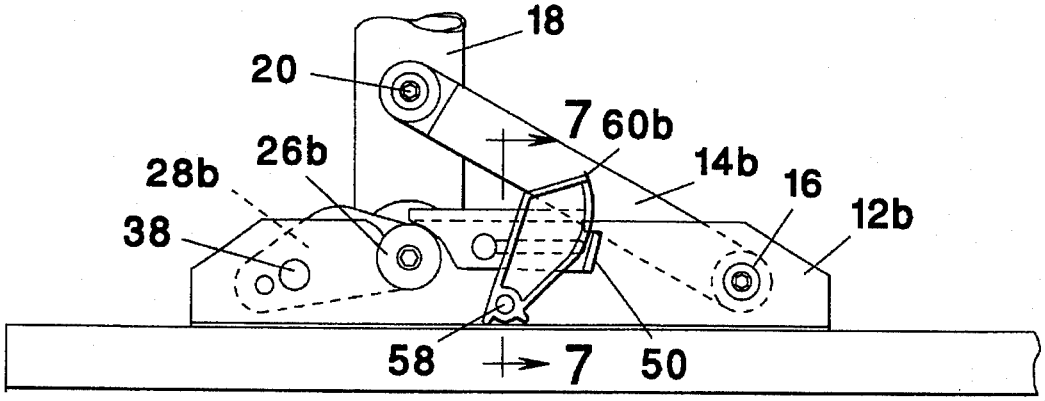
FIG. 4 is a view similar to FIG. 3 illustrating the mechanism in its fully locked position.
Figure 5:
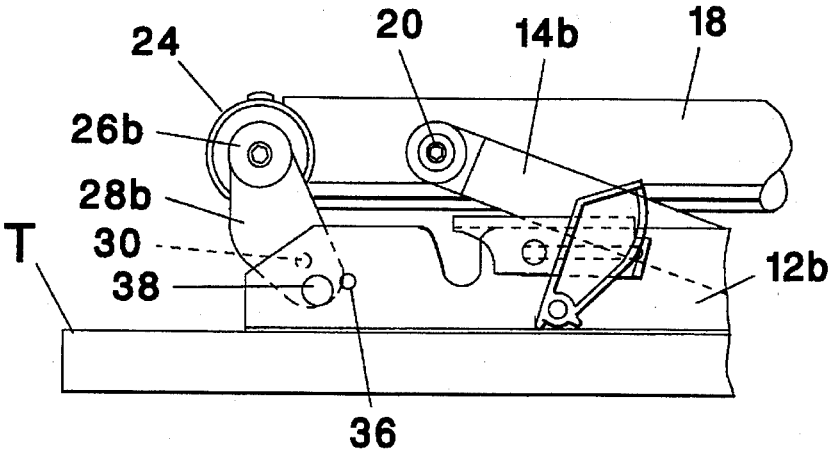
FIG. 5 is a view similar to FIG. 2 illustrating an alternative arrangement of the parts of the mechanism.

In order to fold the table, it may be turned upside down to the position illustrated in FIG. 4. The user's foot may then be employed to depress either of the release levers 60*a, b* causing them to rotate clockwise as viewed in FIG. 4. Since they are interconnected to connecting rod 58, the two release levers move in unison against the actuator tabs 50 to retract both latching bars 48*a, b*. When the nose 52 of each latching bar has been sufficiently retracted, the rotation of the mechanism is simply reversed, allowing the latching pin heads 26*a, b* to be lifted out of the corresponding notches 42 to return the mechanism to the folded position illustrated in FIGS. 1 and 2.

It is believed that the many advantages of this invention will now be apparent to those skilled in the art. It will also be apparent that a number of variations and modifications can be made therein without departing from its spirit and scope. Accordingly, the foregoing description is to be construed as illustrative only, rather than limiting. This invention is limited only by the scope of the following claims.

We claim:

1. In a folding table of the type having a top with a bottom surface and at least one leg foldable between an erected position supporting said table top and a folded position substantially parallel with said bottom surface, the improvement comprising:

first and second substantially parallel spaced brackets mounted to the bottom surface of said table top;

a first pivot link having a first end pivotally mounted to said first bracket and a second end;

a second pivot link having a first end pivotally mounted to said second bracket and a second end;

a pivot bar mounted to said foldable leg, said pivot bar having a first end rotatably supported by the second end of said first pivot link and a second end rotatably supported by the second end of said second pivot link;

a first latching pin carried by the first end of said pivot bar;

a second latching pin carried by the second end of said pivot bar;

a first latching notch formed in said first bracket to receive said first latching pin when said .leg is in its erected position;

a second latching notch formed in said second bracket to receive said second latching pin when said leg is in its erected position;

a first latching bar slidably mounted adjacent said first latching notch for translational movement between a release position unengaged with said first latching pin and a latching position securing said first latching pin within said first latching notch;

means associated with said first latching bar for resiliently urging said first latching pin into said first latching notch while said first latching bar is in its latching position;

a second latching bar slidably mounted adjacent said second latching notch for translational movement between a release position unengaged with said second latching pin and a latching position securing said second latching pin within said second latching notch;

means associated with said second latching bar for resiliently urging said second latching pin into said second latching notch while said second latching bar is in its latching position; and means for moving both of said first and second latching bars into their release positions to permit folding of said leg.

2. The improvement of claim 1 wherein each of said resiliently urging means comprises:

a sloped camming surface on the respective latching bar engageable with its respective latching pin to apply a force thereto having a component aligned to urge said latching pin into its respective latching notch; and a compression spring intermediate said latching bar and bracket to apply said force.

3. The improvement of claim 1 including means for moving both of said first and second latching bars from their latching to their release positions.

4. The improvement of claim 3 wherein said moving means comprises:

a first release lever rotatable to engage and move said first latching bar from its latching to its release position;

a second release lever rotatable to engage and move said second latching bar from its latching to its release position; and means for interconnecting the rotations of said first and second release levers.

5. The improvement of claim 4 wherein at least one of said first and second release levers includes an integral spring contacting a portion of said table to limit movement of said lever when disengaged from its latching bar.

6. The improvement of claim 1 wherein the first end of each of said first and second pivot links includes first and second alternative pivot points with its respective bracket whereby the folded location of said leg from said table top bottom surface may be preselected.

7. The improvement of claim 1 wherein said pivot bar is a tube rotatable substantially 90° between the leg erected and the leg folded positions.

8. The improvement of claim 7 additionally comprising a resilient bumper member supported on the surface of said tube to face away from said table top when the leg is in its folded position.

9. The improvement of claim 8 wherein said bumper member is an elongated strip extending longitudinally along said tube.

10. The improvement of claim 9 wherein said tube defines a plurality of openings therein and wherein said strip includes a plurality of studs frictionally engaged with said openings.

11. The improvement of claim 10 wherein each of said studs includes an enlarged head deformably insertable through one of said openings.

* * * * *